US007704116B2

(12) United States Patent
Jiang et al.

(10) Patent No.: US 7,704,116 B2
(45) Date of Patent: Apr. 27, 2010

(54) METHODS FOR FABRICATING FIELD EMISSION DISPLAY DEVICES

(75) Inventors: Yau-Chen Jiang, Hsinchu County (TW); Ming-Chun Hsiao, Hsinchu (TW); Ying-Hsien Chen, Kaohsiung (TW); Kuang-Chung Chen, Taipei County (TW)

(73) Assignee: Industrial Technology Research Institute, Hsinchu (TW)

( * ) Notice: Subject to any disclaimer, the term of this patent is extended or adjusted under 35 U.S.C. 154(b) by 381 days.

(21) Appl. No.: 11/775,142

(22) Filed: Jul. 9, 2007

(65) Prior Publication Data

US 2008/0014821 A1 Jan. 17, 2008

(30) Foreign Application Priority Data

Jul. 14, 2006 (TW) ..... 95125783 A

(51) Int. Cl.
*H01J 17/49* (2006.01)
*H01J 9/38* (2006.01)

(52) U.S. Cl. ..... 445/24; 445/51; 445/59; 313/495

(58) Field of Classification Search ..... 313/495–497; 445/24–25, 51, 59
See application file for complete search history.

(56) References Cited

U.S. PATENT DOCUMENTS

| | | | | |
|---|---|---|---|---|
| 5,271,890 | A | 12/1993 | Shimura et al. | |
| 6,359,383 | B1 * | 3/2002 | Chuang et al. | 313/496 |
| 6,890,230 | B2 | 5/2005 | Trujillo et al. | |
| 2003/0090190 | A1 * | 5/2003 | Takai et al. | 313/311 |
| 2004/0104660 | A1 | 6/2004 | Okamoto et al. | |
| 2005/0062195 | A1 | 3/2005 | Chao et al. | |

FOREIGN PATENT DOCUMENTS

| | | |
|---|---|---|
| TW | 594824 | 6/2004 |

* cited by examiner

*Primary Examiner*—Nimeshkumar D. Patel
*Assistant Examiner*—Anne M Hines
(74) *Attorney, Agent, or Firm*—Quintero Law Office

(57) ABSTRACT

Methods for fabricating field emission display devices. A first substrate is provided. A cathode structure is formed on the first substrate. A surface treatment procedure is performed on the first substrate with cathode structure thereon. A second substrate opposing the first substrate is provided and assembled in vacuum with a wall rib therebetween. The surface treatment procedure includes free radical oxidization and a supercritical $CO_2$ fluid cleaning.

20 Claims, 9 Drawing Sheets

METHODS FOR FABRICATING FIELD EMISSION DISPLAY DEVICES

BACKGROUND OF THE INVENTION

1. Field of the Invention

The invention relates to field emission display (FED) devices, and in particular to methods for fabricating field emission display devices.

2. Description of the Related Art

Field emission display (FED) devices are panelized conventional cathode ray tube (CRT) displays. Using screen printing technology, large scale FED devices can be achieved. Conventional larger scale FED devices provide low volume, light weight, low power consumption, excellent image quality, and are applicable to a variety of electronic and communication devices. Carbon nanotube or other nano-scale field emitters have benefits such as low threshold field, high emission current density, and high stability due to lower threshold voltage, higher light efficiency, higher viewing angle, and lower power consumption.

Compared with conventional large scale display devices, CRT displays have excellent display quality but occupy a large amount of space. Projection TVs occupy less space but offer poor display quality. Plasma display panel (PDP) displays exhibit lighter, thinner features and can be fabricated by screen printing, nonetheless, they require high power consumption.

Field emission display (FED) devices are self-emitting display devices including an array of micro vacuum tube field emitters. In operation, electrons are emitted from field emitters by biasing control voltage on the gate electrode while maintaining high voltage on the anode such that the emitted electrons bombard the phosphor with large amounts of energy. The field emitters are conventionally formed by semiconductor thin film process to provide an emitter array on the cathode substrate. The field emitters are typically inorganic materials such as Mo, W, Si, or the like. Field emitters formed by semiconductor thin film process, however, require high cost apparatus and are difficult to achieve on a large scale.

FIG. 1 is a cross section of a conventional field emission display device 10, comprising a lower substrate 11 and an opposing upper substrate 12 with a specific gap G therebetween supported by a wall structure. The lower substrate 11 and upper substrate 12 are sealed in a vacuum. A patterned cathode structure 13 is disposed on the lower substrate 11. A field emitter 14 is disposed on the cathode structure 13. The patterned cathode structure 13 is surrounded by a dielectric layer 15 with a gate electrode 16 thereon.

An anode electrode 17 is disposed on the upper substrate 12. A phosphor layer comprising red 18R, green 18G, and blue 18B elements is disposed on the anode electrode 17. A black matrix (BM) 19 is interposed among the phosphor layer with red 18R, green 18G, and blue 18B elements.

To simplify production processes and achieve large scale display, thick film screen printing is employed to fabricate large scale field emission display devices. Conventional thick film screen printing method, however, forms stacked materials as cathode structure on the lower substrate. The stacks are co-fired or sintered at the same temperature. Some impurity residues may remain on the surface of the electron emission layer, creating porous structure, affecting field emission efficiency.

U.S. Pub. No. 2005/0062195, the entirety of which is hereby incorporated by reference, discloses an adhesive film attached on the field emitters of the lower substrate. The adhesive film is released from the field emitters of the lower substrate, thereby removing impurity residues from the surface and improving electron emission alignment to vertical field.

FIGS. 2A-2B are cross sections of a method for fabricating a FED device using an adhesive film attached on the field emitters of the lower substrate. In FIG. 2A, a substrate 35 with a cathode electrode structure 40 thereon is provided. Patterned isolation structure 50 and gate electrode 60 are formed on the cathode electrode structure 40. A field emission structure 70A is attached on the cathode electrode structure 40 using an adhesive tape 30 as shown in FIG. 2B. The field emission structure 70A, however, exhibits degraded field emission efficiency. Moreover, the adhesive tape 30 cannot be reused, increasing production cost. The surface of the field emitters may be damaged during release of the adhesive tape 30. The organic residue from the adhesive tape 30 may result in the field emitter arching at high operating voltages, degrading properties of the FED devices.

In another conventional method for improving field emission uniformity, the surface of the field emitters is rubbed. The field emitters are well-aligned and provide improved electron emission alignment to vertical field. The roller used in the rubbing, however, may leave residual dust or impurities on the surface of the field emitters, which can result in the field emitter arching at high operation voltage, degrading properties of the FED devices.

Another conventional method for improving field emission uniformity is provided by sandblasting the surface of the field emitters. The field emitters are bombarded by high energy small rigid particles to remove impurities. Some particles may, however, remain, degrading properties of the FED devices.

U.S. Pat. No. 6,890,230, the entirety of which is hereby incorporated by reference, discloses a fabrication method for a field emission display device utilizing laser activation to normalize orientation of carbon nanotubes. FIGS. 3A-3B are a cross section of a conventional method of laser activation to create carbon nanotube (CNT) emitters with uniform orientation. In FIG. 3A, a field emission display device comprises a lower substrate 110 with a cathode 120 thereon. A CNT thick film 130 is formed on the cathode 120 as a field emitter. An upper substrate 160 is disposed opposing the lower substrate 110. An anode 150 is disposed on the upper substrate 160. A voltage controller 140 applies bias between the cathode 120 and the anode 150, thereby controlling the field emission display device. A laser source 170 passing through the upper substrate 160 and anode 150 radiates the CNT thick film 130 to activate the field emitter. FIG. 3B is a cross section of the field emission display device activated by laser treatment of FIG. 3A.

The field emission display device activated by laser treatment can, however, be damaged by undesirable heating. For example, the upper substrate 160, anode 150, dielectric layer and gate electrode may be damaged by laser heating. Moreover, if the laser treatment is performed after the field emission display device is assembled, it is difficult to address and align the laser source, inter alia, for high definition FED devices, resulting in intricate fabrication procedures and reduced throughput.

BRIEF SUMMARY OF THE INVENTION

A detailed description is given in the following embodiments with reference to the accompanying drawings.

Accordingly, the invention is related to a surface treatment method for FED devices. By thoroughly removing impurities and contaminants from the field emitters, uniformity of the field emission display device is improved. High-efficiency environmentally friendly surface treatment methods are provided. A plurality of substrates can be treated simultaneously without producing additional contaminants, thereby preventing arching due to high operation voltage and improving stability of the FED device in a high vacuum.

The invention provides a method for fabricating a display device. A first substrate is provided. A cathode structure is formed on the first substrate. A surface treatment is performed on the cathode structure. A second substrate is provided opposing the first substrate with a rib wall structure therebetween, assembled in a vacuum.

The invention further provides a method for fabricating a field emission display. A first substrate is provided. A cathode structure comprising a cathode electrode, a field emitter on the cathode electrode, and a gate electrode is formed by screen printing on the first substrate, wherein the field emitter comprises a carbon nanotube (CNT), a carbon nanofiber (CNF), graphite, palladium oxide (PdO), polysilicon, diamond film, or carbon nitride ($C_xN_y$). A surface treatment is performed on the cathode structure. A second substrate is provided opposing the first substrate with a rib wall structure therebetween, assembled in a vacuum.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the mode of carrying out the invention. This description is made for the purpose of illustrating the general principles of the invention and should not be taken in a limiting sense. The scope of the invention is best determined by reference to the appended claims.

The invention is related to an FED panel and surface treatment methods thereof. The cathode substrate is activated by methods combining free radical oxidization and supercritical carbon dioxide fluid cleaning to improve uniformity and stability of the FED panel. A plurality of cathode substrates can be treated simultaneously to purify and modify surface properties of the field emitters without producing potential contaminants. Furthermore, surface properties of carbon nanotube powders can be modified according to a embodiment, thereby improving uniformity and stability of the FED panel.

Figure 1:
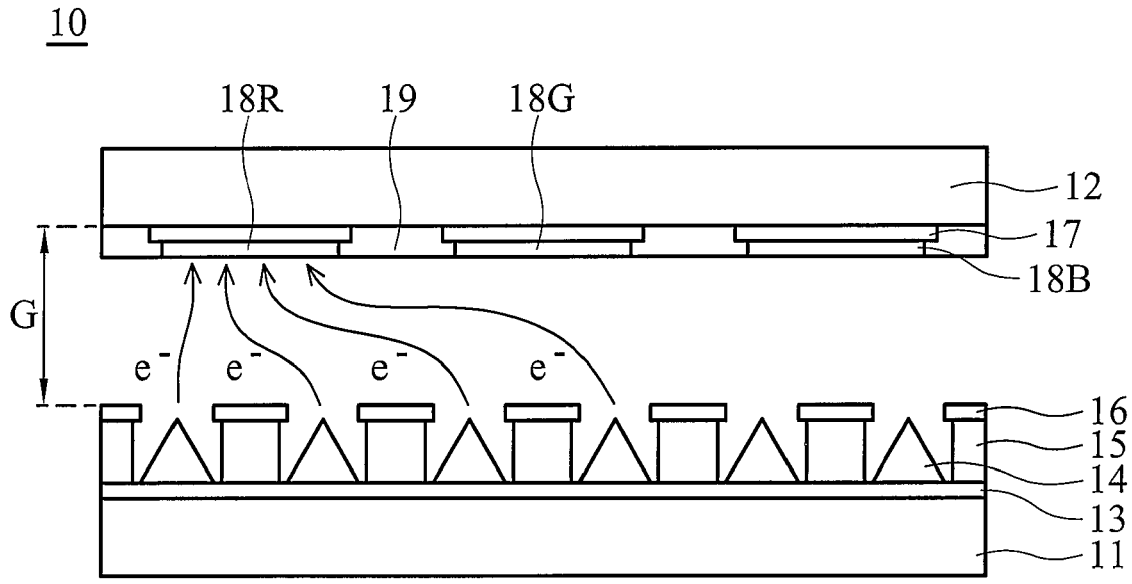
FIG. 1 (RELATED ART)
FIG. 1 is a cross section of a conventional field emission display device.
Figure 2A:
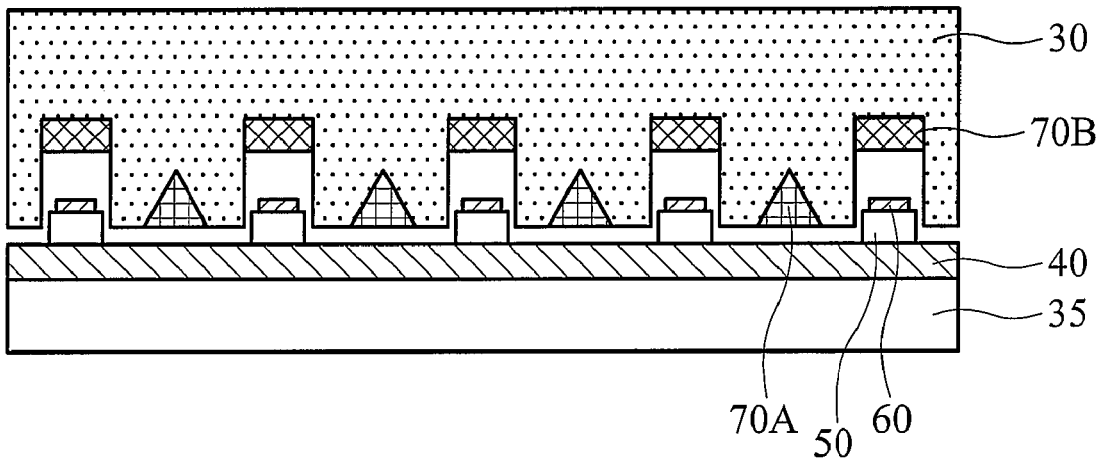
FIGS. 2A-2B are cross sections schematically illustrating a method for fabricating a FED device using an adhesive film attached to the field emitters of the lower substrate.
Figure 2B:
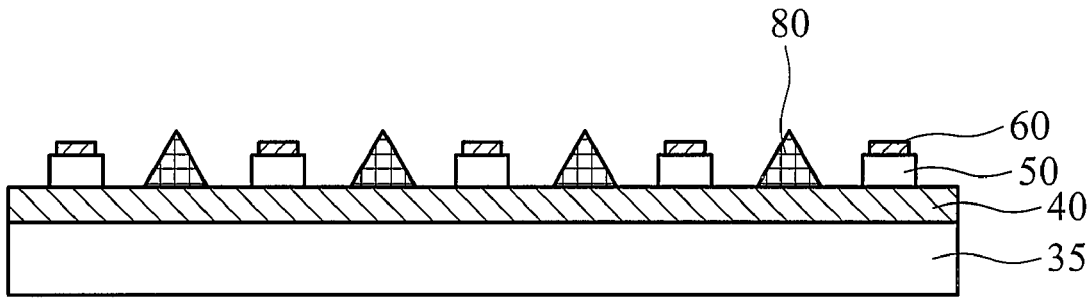
Figure 3A:
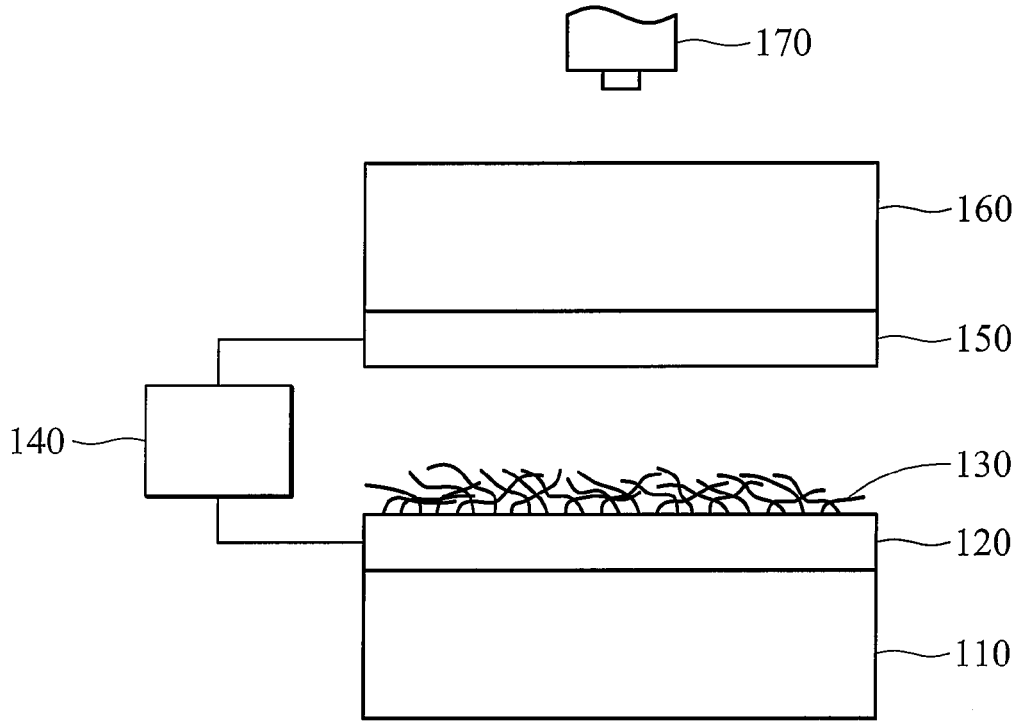
FIG. 3A is a cross section of a conventional method of laser activation to create carbon nanotube (CNT) emitters with uniform orientation.
Figure 3B:
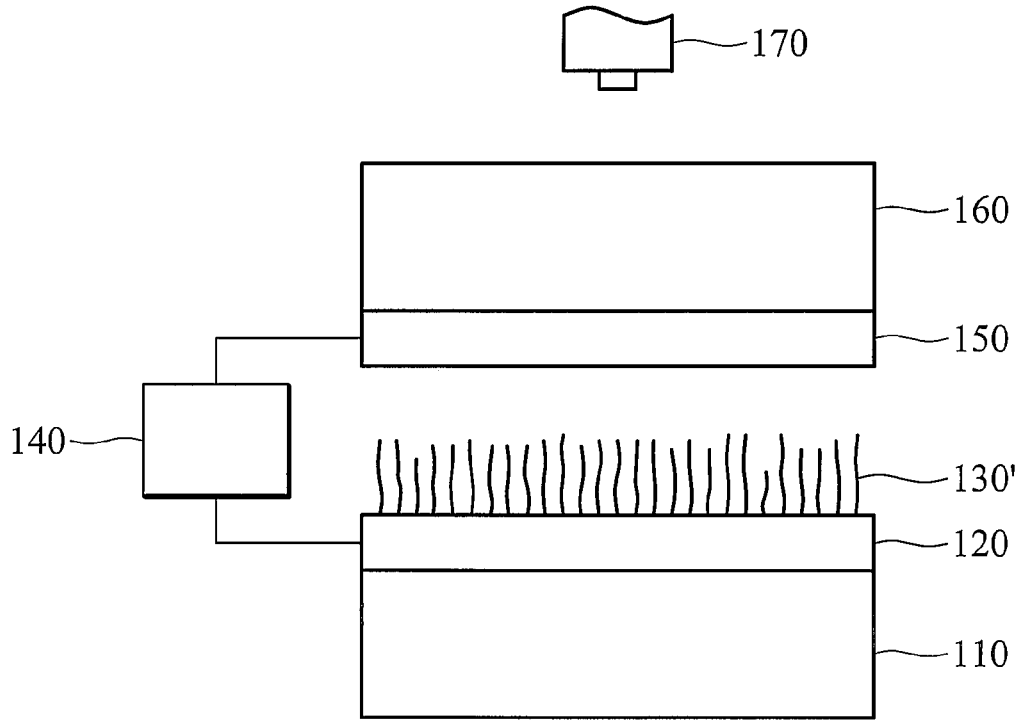
FIG. 3B is a cross section of the field emission display device activated by laser treatment of FIG. 3A.
Figure 4A:
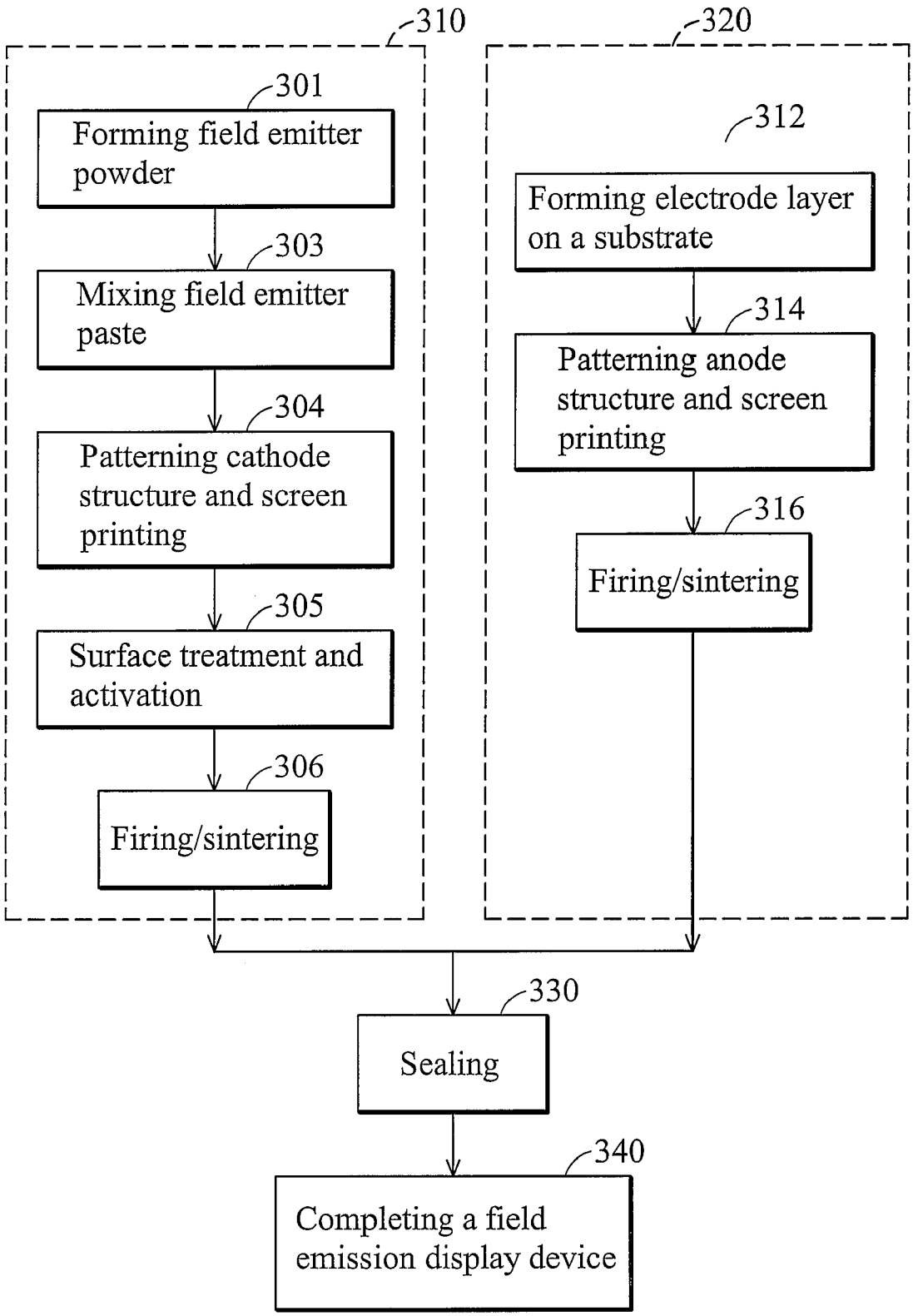
FIG. 4A is a fabrication flowchart of a FED panel according to an embodiment of the invention.

FIG. 4A is a fabrication flowchart of a FED panel according to an embodiment of the invention. In step 310, a lower substrate of the FED panel is formed. In step 320, an upper substrate of the FED panel is formed. In step 330, the lower substrate and the upper substrate are assembled and sealed in a vacuum, thus the field emission display device is completed.

Step 310 of forming a lower substrate of the FED device comprises synthesizing field emitter powders (ex. CNT) (step 301) by, for example, arc discharge, chemical vapor deposition (CVD), or laser ablation. The field emitter powders are gathered in a container. The field emitter powders are mixed into a field emitter paste in step 303. Next, in step 304, a patterned cathode structure is formed by screen printing the field emitter paste on a substrate. Surface treatment and activation (step 305) are performed on the patterned cathode structure. The patterned cathode structure is sintered or fired (step 306) to complete the lower substrate of the field emission display (FED) device.

Step 320 of forming an upper substrate of the FED device comprises forming a conductive layer or electrode on a substrate (step 312). Next, in step 314, a patterned anode structure is formed on the substrate and sintered (step 316). A fluorescent layer is formed on the anode structure to complete the upper substrate of the field emission display (FED) device.

Figure 4B:
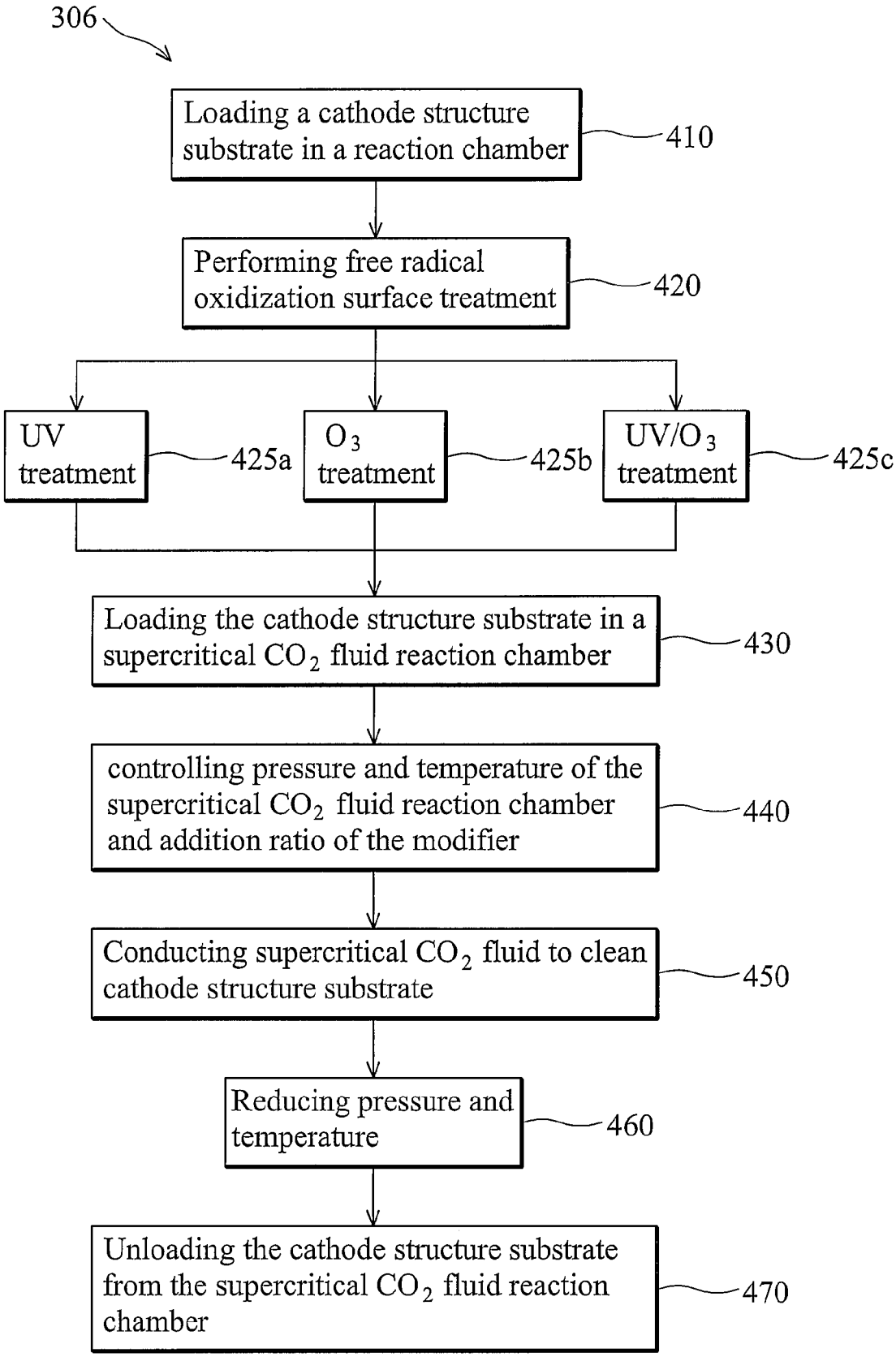
FIG. 4B is a flowchart showing the surface treatment and activation of FIG. 4A.

FIG. 4B is a flowchart showing the surface treatment and activation of FIG. 4A. The surface treatment and activation comprises loading a cathode structure substrate in a reaction chamber (step 410). Subsequently, a free radical oxidization surface treatment (step 420) is performed. The step of free radical oxidization surface treatment can optionally comprise UV treatment (425*a*), $O_3$ treatment (425$_b$), or UV/$O_3$ treatment (425*c*). After the free radical oxidization surface treatment, the cathode structure substrate is transferred to a supercritical $CO_2$ fluid reaction chamber in step 430. Subsequently, a supercritical $CO_2$ fluid cleaning treatment is performed. The cathode structure substrate is loaded in a supercritical $CO_2$ fluid reaction chamber. After the pressure and temperature of the supercritical $CO_2$ fluid reaction chamber and addition ratio of the modifier are set, the supercritical $CO_2$ fluid is conducted into the chamber to clean cathode structure substrate (steps 440 and 450). After the cleaning step is completed, the pressure and temperature of the reaction chamber are reduced followed by removal of the cathode structure substrate from the supercritical $CO_2$ fluid reaction chamber (steps 460 and 470).

The physical properties of supercritical fluid are similar to transition between gas phase and liquid phase. The supercritical fluid exhibits low viscosity, high diffusion coefficient, and low surface tension similar to gas phase, but further high density like liquid phase. Chemical properties of the supercritical fluid differ from gas phase and liquid phase, such as the supercritical $CO_2$ fluid, thereby becoming organically soluble. The organic solubility of the supercritical $CO_2$ fluid depends on temperature and pressure of the supercritical fluid. The organic solute in the supercritical $CO_2$ fluid is precipitated with temperature and pressure reduction, producing gas phase $CO_2$ which is recyclable.

Figure 5A:
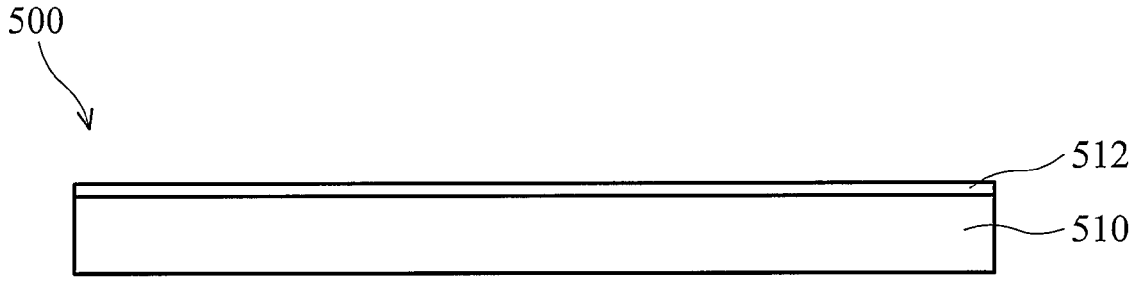
FIGS. 5A-5C are cross sections showing fabrication of a substrate structure for a field emission display (FED) device according to an embodiment of the invention.
Figure 5B:
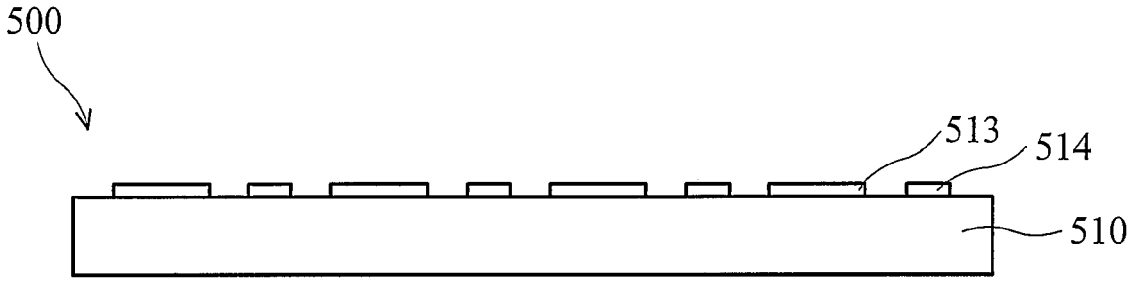
Figure 5C:
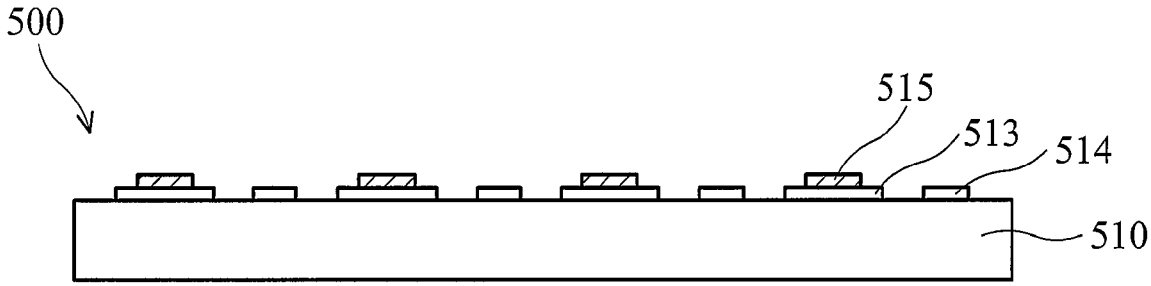

FIGS. 5A-5C are cross sections showing fabrication steps of a substrate structure for a field emission display (FED) device according to an embodiment of the invention. Referring to FIG. 5A, a substrate 510 such as a glass substrate or a flexible substrate is provided. A conductive layer 512 is formed on the substrate 510.

Referring to FIG. 5B, the conductive layer 512 is patterned into a cathode electrode pattern 513 and a gate line pattern 514 by, for example, lithography or etching. Alternatively, a patterned conductive layer 512 can be screen printed on the substrate 510.

Referring to FIG. 5C, a field emitter 515 is formed on the cathode electrode pattern 513 by, for example, carbon nanotube paste screen printing, completing fabrication of the substrate with cathode structure. Note that the formation of the field emitter 515 can optionally comprise screen printing, micro-contact printing, ink-jet printing, electrophoresis deposition (EPD), or chemical vapor deposition (CVD). Furthermore, the field emitter can comprise a carbon nanotube (CNT), a carbon nanofiber (CNF), graphite, palladium oxide (PdO), polysilicon, diamond film, or carbon nitride ($C_xN_y$).

Figure 6A:
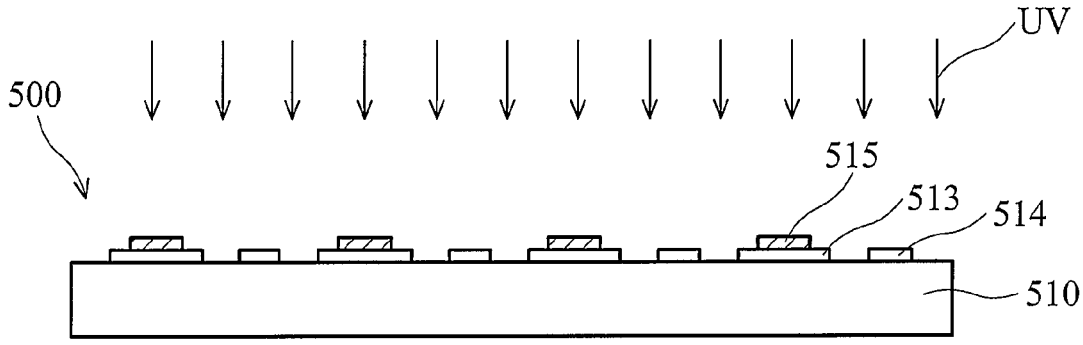
FIGS. 6A-6B are schematic views illustrating free radical oxidization treatment and supercritical $CO_2$ fluid treatment of the cathode substrate according to an embodiment of the invention.
Figure 6B:
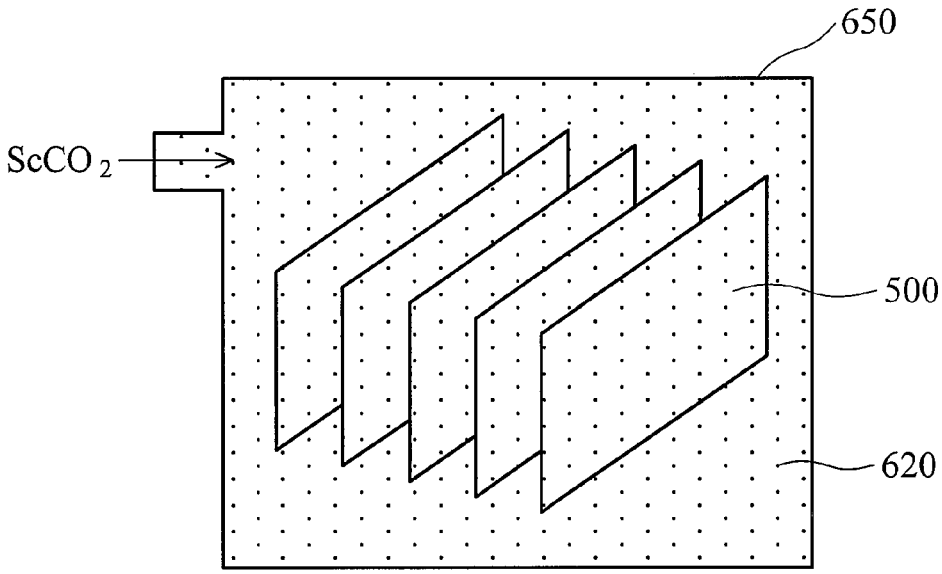

FIGS. 6A-6B are schematic views illustrating free radical oxidization treatment and supercritical $CO_2$ fluid treatment of the cathode substrate according to an embodiment of the invention. Referring to FIG. 6A, the cathode substrate for the FED device is irradiated by a UV light source with a wavelength in a range of 185-254 nm. Preferably, the wavelength of the UV light source is 185 nm or 254 nm in about 3 min. The distance between the cathode substrate and the UV light source is about 0.2 cm. Alternatively, $O_3$ can be conducted into the process chamber during UV irradiation, or simply conduct $O_3$ gas performing free radical oxidization.

Subsequently, referring to FIG. 6B, the cathode substrate for the FED device is transferred into a processing chamber 650 full of supercritical $CO_2$ fluid 620. After gas phase to supercritical fluid phase transition, the supercritical $CO_2$ fluid becomes organically soluble. Operating pressure of the supercritical $CO_2$ fluid is preferably controlled at about 3000 psi, and that of the supercritical $CO_2$ fluid is preferably controlled at about 50° C. The supercritical $CO_2$ fluid cleaning lasts about 5 min. More preferably, an additional modifier such as 7% n-propanol can improve the cleaning capability of the supercritical $CO_2$ fluid.

Figure 7:
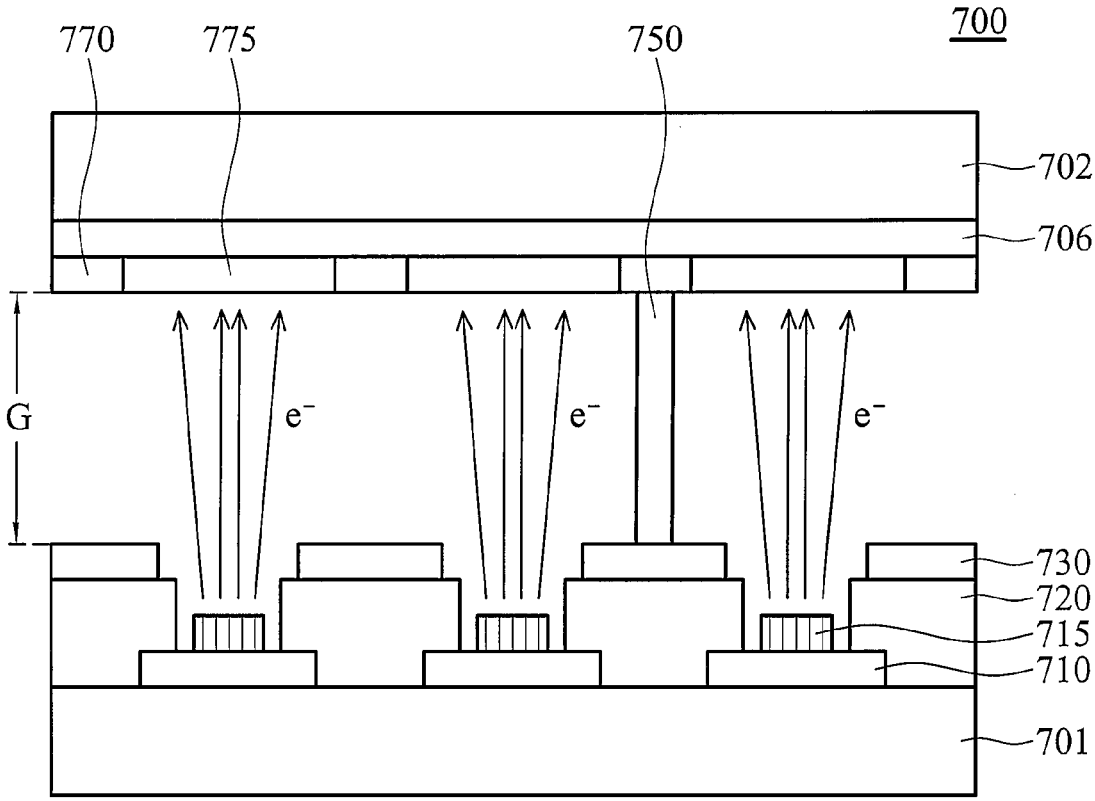
FIG. 7 is a cross section of a CNT-FED device according to an exemplary embodiment of the invention.

FIG. 7 is a cross section of a CNT-FED device according to an exemplary embodiment of the invention. In FIG. 7, a CNT-FED device 700 comprises a lower substrate 701 and an upper substrate 702. A wall structure 750 or a rib structure separates the lower and upper substrates by a predetermined gap G. The lower and upper substrates are sealed in a vacuum. The lower substrate 702 includes a patterned cathode structure 710. A CNT thick film 715 is disposed on the patterned cathode structure 710 to serve as a field emitter. A dielectric layer 720 surrounding the patterned cathode structure 710 is disposed on the lower substrate 702. A gate electrode 730 is disposed on the dielectric layer 720.

An anode electrode 706 is disposed on the upper substrate 702. Red, green, and blue fluorescent layers 775 are alternatively disposed on the anode electrode 706. A black matrix 770 is disposed between the red, green, and blue fluorescent layers 775.

The invention provides a surface treatment method comprising free radical oxidization and supercritical $CO_2$ fluid cleaning. The surface treatment method is applicable with FED devices comprising a horizontal triode structure, a vertical triode structure, or an undergate triode structure. The disclosed treatment deeply cleans the field emitter without leaving impurities or contaminants, resulting in increased brightness and improved display uniformity.

While the invention has been described by way of example and in terms of the embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for fabricating a display device, comprising:

providing a first substrate;

forming a cathode structure on the first substrate;

surface treating the cathode structure; and providing a second substrate opposing the first substrate with a rib wall structure therebetween, assembled in a vacuum, wherein the surface treatment comprises free radical oxidization and supercritical carbon dioxide cleaning.

2. The method as claimed in claim 1, wherein the cathode structure comprises a horizontal triode structure, a vertical triode structure, or an under gate triode structure.

3. The method as claimed in claim 1, wherein the cathode structure comprises a cathode electrode, a field emitter on the cathode electrode and a gate electrode.

4. The method as claimed in claim 3, wherein the field emitter comprises a carbon nanotube (CNT), a carbon nanofiber (CNF), graphite, palladium oxide (PdO), polysilicon, diamond film, or carbon nitride (CxNy).

5. The method as claimed in claim 3, wherein the field emitter is formed by screen printing, micro-contact printing, ink-jet printing, electrophoresis deposition (EPD), or chemical vapor deposition (CVD).

6. The method as claimed in claim 1, wherein the free radical oxidization comprises illuminating the surface of the cathode structure by ultraviolet light.

7. The method as claimed in claim 1, wherein the free radical oxidization comprises conducting ozone on the surface of the cathode structure.

8. The method as claimed in claim 1, wherein the free radical oxidization comprises conducting ozone on the surface of the cathode structure and illuminating the surface of the cathode structure by ultraviolet light.

9. The method as claimed in claim 1, wherein the supercritical carbon dioxide cleaning comprises positioning the first substrate in a chamber, conducting a supercritical carbon dioxide into the chamber, wherein the supercritical carbon dioxide comprises a modifier.

10. A method for fabricating a field emission display, comprising:

providing a first substrate;

surface treating a cathode structure on the first substrate; and providing a second substrate opposing the first substrate with a rib wall structure therebetween, assembled in a vacuum, wherein the surface treatment comprises free radical oxidization and a supercritical carbon dioxide cleaning.

11. The method as claimed in claim 10, wherein the free radical oxidization comprises illuminating the surface of the cathode structure by ultraviolet light.

12. The method as claimed in claim 11, wherein a wavelength of the ultraviolet light is approximately between 185 nm to 254 nm.

13. The method as claimed in claim 10, wherein the free radical oxidization comprises conducting ozone on the surface of the cathode structure.

14. The method as claimed in claim 10, wherein the free radical oxidization comprises conducting ozone on the surface of the cathode structure and illuminating the surface of the cathode structure by ultraviolet light.

15. The method as claimed in claim 10, wherein the supercritical carbon dioxide cleaning comprises positioning the first substrate in a chamber, conducting a supercritical carbon dioxide into the chamber, wherein the supercritical carbon dioxide comprises a modifier.

16. The method as claimed in claim 15, wherein a pressure of the supercritical carbon dioxide is approximately 3000 psi, and a temperature of the supercritical carbon dioxide is approximately 50° C.

17. The method as claimed in claim 15, wherein the modifier comprises n-propanol.

18. The method as claimed in claim 10, wherein the second substrate comprises an anode electrode and a fluorescent layer.

19. The method as claimed in claim 10, further comprising screen printing a cathode structure comprising the cathode electrode, a field emitter on the cathode electrode, and a gate electrode on the first substrate.

20. The method as claimed in claim 19, wherein the field emitter comprises a carbon nanotube (CNT), a carbon nanofiber (CNF), graphite, palladium oxide (PdO), polysilicon, diamond film, or carbon nitride ($C_xN_y$).

* * * * *